US005253763A

United States Patent [19]

Kirkley et al.

[11] Patent Number: 5,253,763

[45] Date of Patent: Oct. 19, 1993

[54] COLLAPSIBLE CONTAINER

[76] Inventors: David C. Kirkley, 2112 Firestone Dr., League City, Tex. 77573; James L. Bereck, 1811 San Jose, Friendswood, Tex. 77564

[21] Appl. No.: 928,049

[22] Filed: Aug. 11, 1992

[51] Int. Cl.[5] ..... B65D 19/14

[52] U.S. Cl. ..... 206/600; 217/15

[58] Field of Search ..... 206/600; 217/15; 220/4.28

[56] References Cited

U.S. PATENT DOCUMENTS

| | | | |
|---|---|---|---|
| 616,550 | 12/1898 | Moss | 217/15 |
| 687,807 | 12/1901 | Winter | 217/15 |
| 827,877 | 8/1906 | McCain | 217/15 |
| 1,184,156 | 5/1916 | Wikler, Jr. | 217/15 |
| 1,204,611 | 11/1916 | Therio | 217/15 |
| 1,254,482 | 1/1918 | Davis | 217/15 |
| 2,936,090 | 5/1960 | Caldwell | 217/15 |
| 3,107,023 | 10/1963 | Jacobson et al. | 217/15 |
| 4,577,772 | 3/1986 | Bigliardi . | |
| 4,998,637 | 3/1991 | Marovskis . | |
| 5,036,979 | 8/1991 | Selz . | |
| 5,056,666 | 10/1991 | Janssens . | |
| 5,056,667 | 10/1991 | Coogan . | |

FOREIGN PATENT DOCUMENTS

| | | | |
|---|---|---|---|
| 166810 | 7/1921 | United Kingdom | 217/15 |
| 766409 | 1/1957 | United Kingdom | 217/15 |

*Primary Examiner*—William I. Price
*Attorney, Agent, or Firm*—Richard C. Litman

[57] ABSTRACT

A collapsible container for transporting or storing general cargo, preferably has a pair of opposing side walls connected by hinge means to a rectangular base. Front and rear walls of similar configuration are removably joined to the base. A cover panel, removably joined to the side, front, and rear walls defines a closed container of predetermined volume. To permit the container to be reduced in volume, each side wall has a central hinge defining an upper and a lower panel adapted to be folded upon themselves and toward the interior of the container into a collapsed condition. Additionally, the front and rear walls are shaped and dimensioned to be horizontally positioned, one above the other, atop said side walls when collapsed and the cover panel horizontally positioned thereabove.

2 Claims, 3 Drawing Sheets

COLLAPSIBLE CONTAINER

BACKGROUND OF THE INVENTION

1. Field of the Invention

The present invention relates generally to special receptacles or packages for the transportation of general cargo and, more specifically, to an improved container which may be folded for storage when not in use.

2. Description of the Related Art

Storage and shipping containers comprising upright walls which may be collapsed onto a supporting pallet base for storage purposes are, of course, well known. Such containers have been utilized for the transportation of cargo by air, rail, and roadway for many years. Such containers permit the highly mechanized handling of large volumes of goods with minimal damage or breakage thereto. Additionally, these containers may be folded to reduce their volume required for storage or for expeditious return to their point of origin for reloading.

It has been noted that certain prior art containers can be reduced in volume such that at least four collapsible containers can be transported in the place of one rigid container. Many shortcomings become readily apparent, however, when the prior art containers are closely examined. Such shortcomings include: fragile design, special handling needs, reduced storage volumes due to interior reinforcement structures, as well as complex and costly construction.

U.S. Pat. No. 4,577,772, issued Mar. 25, 1986 to Juan B. Bigliardi, for example, discloses a collapsible shipping container including opposite side walls each comprising a medial hinge joining an upper and lower panel. Top and bottom panels are pivotally attached to the respective edges of the side walls by complex locking hinge elements. The container further comprises end door panels pivotally attached thereto. Apparently, the end door panels are prevented from retracting into the container, as designed, when such is completely filled with cargo.

U.S. Pat. No. 4,998,637, issued Mar. 12, 1991 to Harijs B. Marovskis, shows a shipping container having side and end walls pivotally joined to a central base in a cross-shaped configuration when unfolded for storage. A top, fitted within a retaining grooves in said walls, provides a closure for the container when utilized for transport purposes. A large surface area is required to store this particular container when collapsed.

U.S. Pat. No. 5,036,979, issued Aug. 6, 1991 to Selz, describes a container having opposite side walls capable of collapsing in an accordion-like manner about medial scorelines provided therein. Said side walls are constructed, in the preferred embodiment, of corrugated paperboard and vertical loads imposed upon the container a borne by upright corner posts positioned within the container.

U.S. Pat. No. 5,056,666, issued Oct. 15, 1991 to Werner J. Janssens, provides a collapsible pallet comprising a base and a plurality of segregated flat panels which may be assembled to form a rectangular open-topped box. The upright edges of two opposing panels are formed with inwardly-directed flanges, the lower portion of which form U-shaped sockets that the remaining panels may be inserted into and retained in a vertical orientation. Complex, square section hook means retain the upper ends each of the panels in locked engagement.

For transport and storage purposes, the container may be dismantled and the panels stored flat on the base.

U.S. Pat. No. 5,056,667, issued Oct. 15, 1991 to James D. Coogan, discloses a collapsible pallet cage having a rectangular base with upwardly projecting skirting walls extending therefrom, each said wall being a different height above the base. Above each skirting wall, side and end wall panels are pivotally supported by vertical posts. A spring loaded latching mechanism retains adjacent panels in a locked relationship for use.

None of the above inventions and patents, taken either singly or in combination, is seen to describe the instant invention as claimed.

SUMMARY OF THE INVENTION

Accordingly, it is a principal object of the invention to provide an improved collapsible container of sturdy and elegant construction, adaptable to any size requirements, which permits the vertical walls thereof to be conveniently folded to a storage configuration of reduced volume with minimal effort.

It is another object of the invention to provide an improved collapsible container wherein adjacent vertical walls may be locked together when in their erected condition by means of retaining straps which are unlikely to disengage during use, do not project into the interior of the container, and which are designed to hold the container in its storage configuration when not in use.

It is a further object of the invention to provide an improved collapsible container which may be collapsed or reassembled without the use of tools of any kind.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
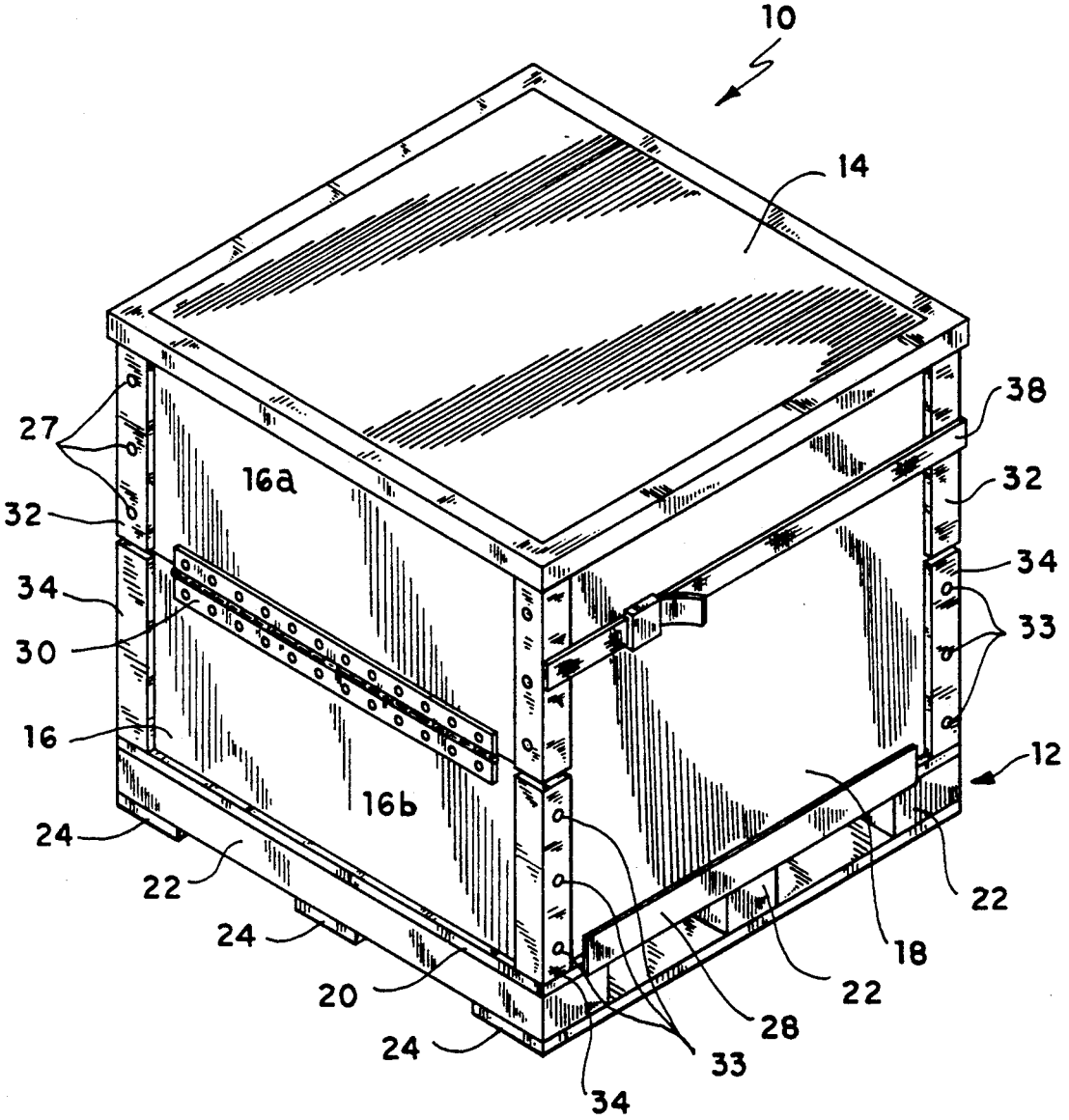
FIG. 1 is a perspective view of a collapsible container in accordance with this invention.

Referring now to the embodiment of the invention shown in the figures by way of example only, a collapsible container 10 comprises a rectangular base 12, a cover panel 14, a pair of substantially identical sidewalls 16 opposite each other, and a pair of substantially identical front and rear walls 18, also opposite each other. The container is generally of box-like rectangular shape, and in the preferred embodiment has a square plan. Thus, when container 10 is in the assembled state for transport purposes, as shown in FIG. 1, with side walls 16 and 18 respectively joined to base 12 and cover panel 14 positioned upon the upper edge of said walls providing a closure thereto, a cubic shape is formed.

Base 12 typically comprises a horizontal floor or bottom panel 20 of plywood sheet material, or the like resting upon a plurality of horizontal support members 22 which, in turn, are mounted to a plurality of base stringers 24 perpendicular to such support members. In order to provide spaces for receiving the tines of a forklift which may be utilized for moving the container, support members 22 are appropriately sized and distanced from one another. Respective side walls 16 are joined to bottom panel 20 by hinges 26 secured by threaded fastening means, as shown generally at 27. However, other fastening means may be provided. When assembled for transport purposes, front and rear walls 18 are engaged along their respective lower edges by the upstanding flange provided by opposing angle metal frames 28 affixed to the bottom surface of panel 20. Thus the upstanding flange provided by each frame 28 serves as a stop to limit or inhibit the respective amount of movement of front and rear walls 18 in an outward direction.

Figure 2:
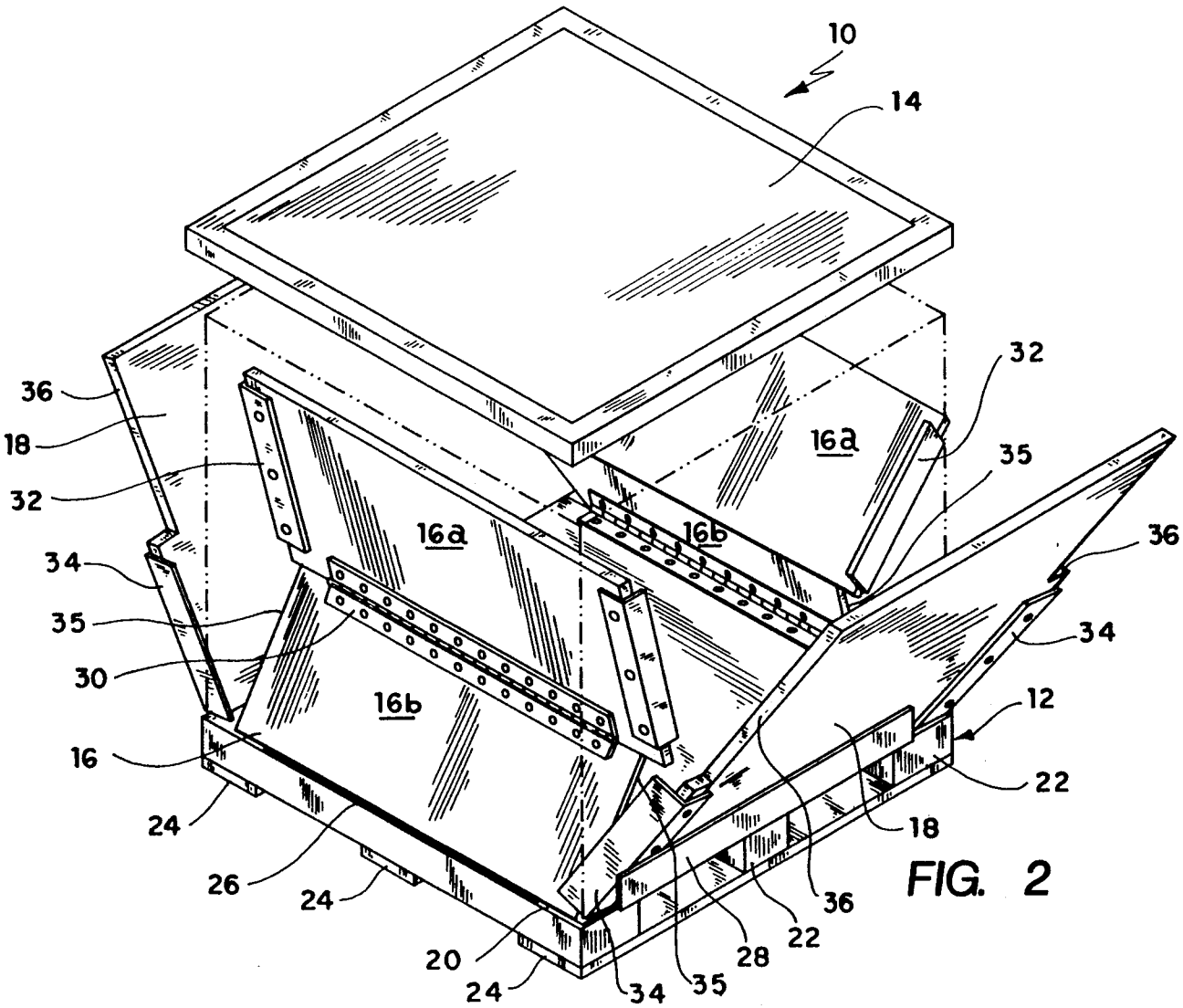
FIG. 2 is a partially exploded perspective view of the container of FIG. 1 in a folded down condition.

Known in the design of collapsible containers of the type to which the present invention refers, side walls 16 are provided with a longitudinal central fold line formed by hinge 30. The hinge line delimits each of side wall panels 16*a* and 16*b* which, in turn, are connected through corresponding longitudinal hinges 26 to base 12. When joined together, panels 16*a* and 16*b* describe a generally rectangular configuration, preferably square, and of substantially the same size as bottom panel 20. It can be seen in FIG. 2 that upper panel 16*a* includes two angle metal brackets 32. Brackets 32 form an inwardly directed flange along the upright edges of each panel 16*a*. Each of brackets 32 is a length of aluminum, steel, iron, or the like, substantially equal to the height of panel 16*a* and bent or formed at a right angle along its long dimension. Brackets 32 are used to support the structural framework of container 10 and are secured to panel 16*a* by threaded fastening means, not shown in the figures. However, other fastening means may be utilized with equal facility.

Front and rear walls 18 are generally rectangular in configuration, preferably square, and of substantially the same size as bottom panel 20. Walls 18 may be disconnected from base 12 and may be laid flat thereon, in a manner discussed below, for storage. It can be seen in FIG. 2 that each of walls 18 further comprise two angle metal brackets 34. Brackets 34 form an inwardly directed flange along the upright edges of each wall 18 and extend approximately one half of the distance from the bottom of each wall to the top thereof or substantially the height of adjoining panel 16*b*. Each of brackets 34 is a length of aluminum, steel, iron, or the like, and bent or formed at a right angle along its long dimension. Brackets 34, like brackets 32, are used to support the structural framework of container 10 and are respectively secured to each of walls 18 by threaded fastening means 33. Other fastening means may be provided, however.

The upright edges defining the respective thicknesses of walls 16 and 18 are each provided with corresponding rabbets having a depth substantially equivalent to the thickness of the adjoining wall. Each side wall 16 is provided with rabbets 35 by reducing the width of lower panel 16*b* with respect to the width of upper panel 16*a*. Inside walls 16, then, the width of upper panel 16*a* is equivalent to the width of panel 16*b* plus that of twice the thickness of wall 18. Additionally, front and rear walls 18 are provided with similar rabbets 36 along their upright edges. Rabbets 36 extend approximately one half of the distance from the top of each said wall to the bottom thereof or substantially the height of adjoining panel 16*a*. Each rabbet 36 has a depth substantially equivalent to the thickness of wall 16. When container 10 is utilized for transporting cargo, the lower portion of each wall 18 will insert into a rabbet 35 in corresponding wall 16 and the upper portion of wall 16 will insert into a rabbet 36 in corresponding wall 18. The inwardly directed flanges provided by brackets 32 and 34, serve as a stop, therefore, to limit the amount of movement of adjoining walls 16 and 18 at their points of intersection.

In the preferred embodiment, walls 18, as well as walls 16, are comprised of plywood of similar thickness; however, any rigid sheet material may be employed therein. Well-known urethane finishes, fiberglass coatings, and the like, may be applied to front and rear walls 18 and the remainder of container 10 to provide such with increased weather resistance, washability, and durability.

Figure 3:
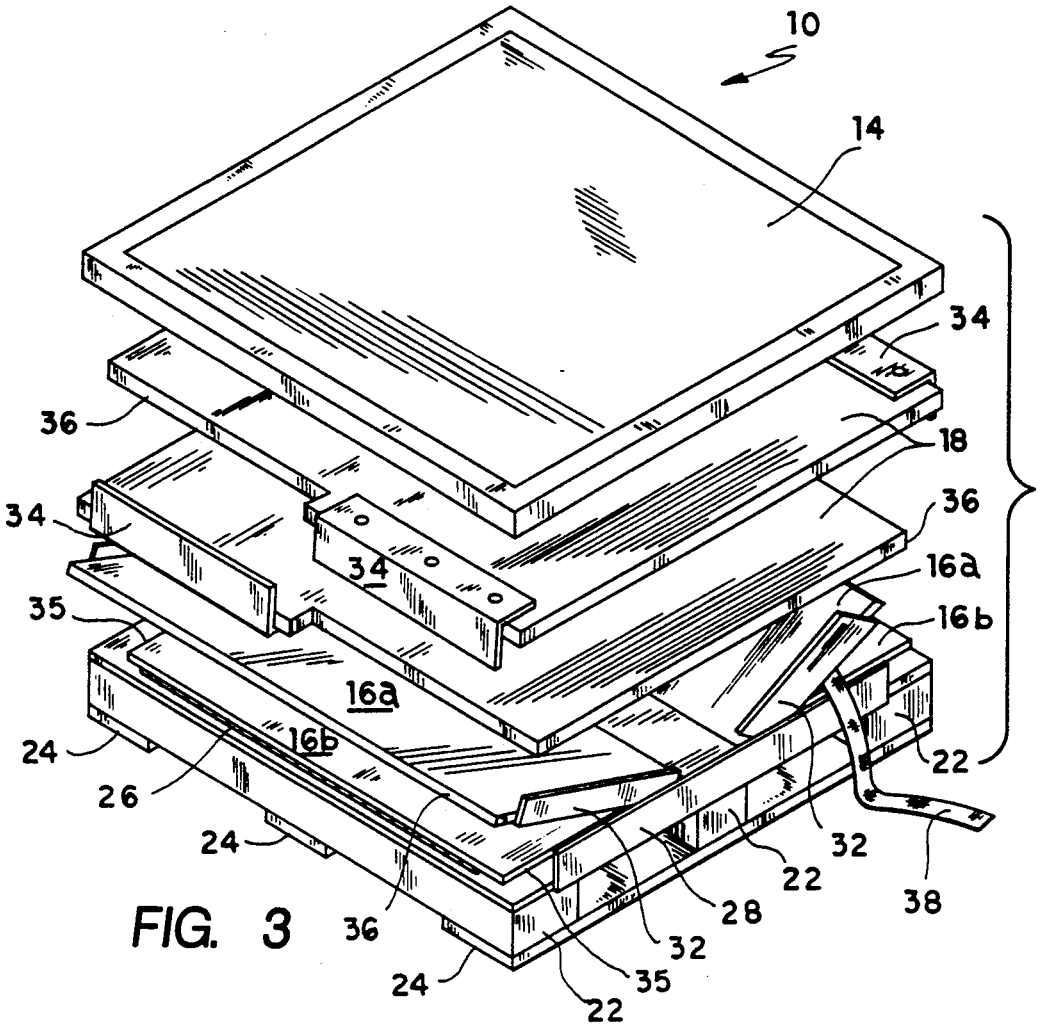
FIG. 3 is a partially exploded perspective view of the container of FIG. 2 in a further folded down condition.
Figure 4:
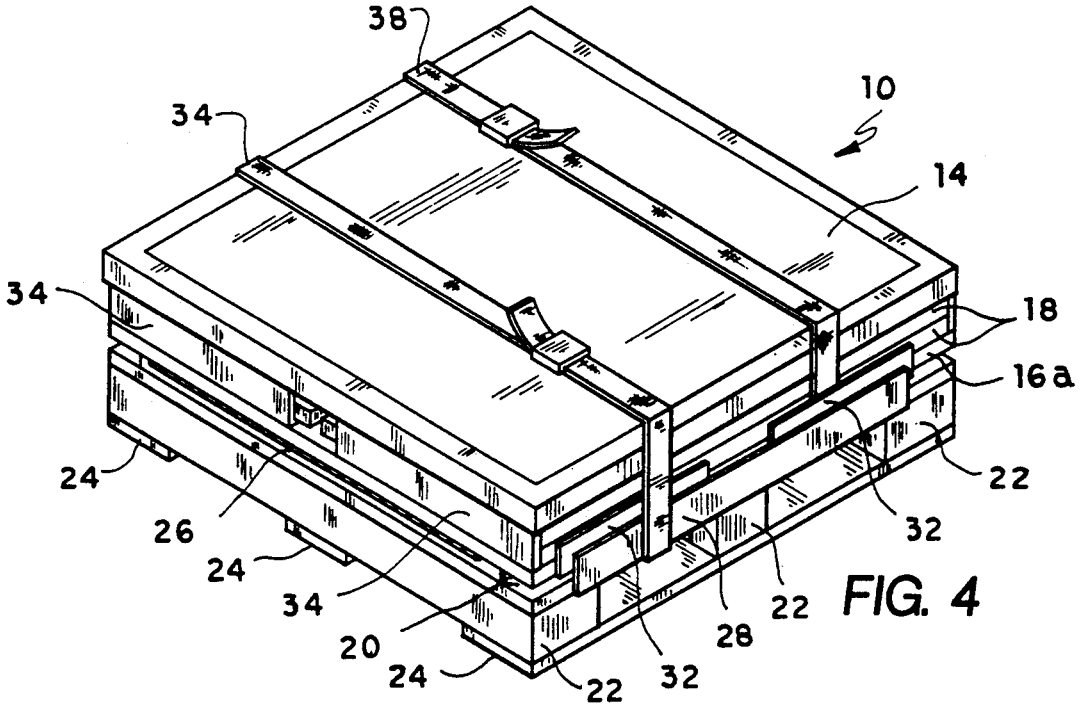
FIG. 4 is a perspective view of the container in a fully collapsed condition with its cover secured for storage.

It follows from the above description that collapsing container 10 may be accomplished by first removing cover panel 14 from the container. With cover panel 14 removed, retaining straps 38 may be unbuckled in the usual manner thereby permitting movement of walls 16 and 18. (When utilized for transport purposes, straps 38 join opposing side walls 16 and attach, at each end, to angle brackets 32 thereby retaining container 10 in a box-like configuration.) Next, front and rear walls 18 are tilted outward from the center of container 10 and are removed from their engagement with angle metal frames 28 and temporarily set aside with panel 14. Side walls 16 are then manipulated in an accordion-like fashion about their respective hinges such that each wall folds onto base 12 occupying approximately one half the surface area thereof. As is shown in FIG. 3, lower panels 16*b* come to rest upon base 12. Upper panels 16*a*, in turn, fall upon their attached counterpart panels 16*b* below. Further, front and rear walls 18 are pivoted into position and placed horizontally atop folded walls 16. In positioning walls 18, the flanged surface of each attached bracket 32 is first upwardly oriented and then the upper edge of one wall 18 is placed against the lower edge of the other, in this manner, container 10 is folded into a space of minimal volume. Finally, cover panel 14 is horizontally positioned immediately above and adjacent to the now stacked walls 18. Retaining straps 38 may now be refastened and tightened thereby securing container 10 in a collapsed condition for storage. The assembly of container 10 for transport purposes may be readily accomplished by performing the aforesaid process in reverse.

It is to be understood that the present inventive container is not limited to the sole embodiment described above, but encompasses any and all embodiments within the scope of the following claims.

I claim:

1. A collapsible container for the transportation of general cargo, comprising:

a rectangular base having a bottom panel forming a horizontal floor for said container;

a pair of opposing side walls connected by hinge means to said rectangular base, each of said walls including:

a central hinge defining an upper and a lower panel of substantially equal surface area adapted to be folded upon themselves and toward the interior of said container into a collapsed condition upon said floor;

a front wall removably joined to said base;

a rear wall removably joined to said base;

said side, front, and rear walls including:

a plurality of upright edges defining the thickness of each of said walls;

said side walls further including:

a rabbet in each of said upright edges for receiving said front and rear walls; and, each said front and rear walls further including:

a rabbet in each of said upright edges for receiving said side walls;

a cover panel removably joined to said side, front, and rear walls defining a closed container of predetermined volume, whereby when said side walls are in a collapsed condition, said front and rear walls are shaped and dimensioned to be horizontally positioned, one above the other, thereupon, and said cover panel is shaped and dimensioned to be fitted horizontally atop said front and rear walls.

2. A collapsible container for the transportation of general cargo, comprising:

a rectangular base having a bottom panel forming a horizontal floor for said container, said base adapted to receive the tines of a forklift;

a pair of opposing side walls connected by hinge means to said rectangular base, each of said walls including:

a central hinge defining an upper and a lower panel of substantially equal surface area adapted to be folded upon themselves and toward the interior of said container into a collapsed condition upon said floor, and a plurality of first angle metal brackets joined to said upper panel, each said bracket forming an inwardly directed flange;

a front wall removably joined to said rectangular base;

a rear wall removably joined to said base, wherein said front and rear walls are of the same configuration and are adapted to be stacked atop said side walls when such are in a collapsed condition, each of said front and rear walls further include:

a plurality of second angle metal brackets joined thereto, each said bracket forming an inwardly directed flange and extending from the bottom of said wall upward a distance substantially equal to the height of said lower panel;

said side, front, and rear walls further including:

a plurality of upright edges defining the width of each of said walls;

said side walls further including:

a rabbet in each of said upright edges for receiving said front and rear walls; and, each of said front and rear walls further including:

a rabbet in each of said upright edges for receiving said side walls;

a pair of opposing angle metal frames joined to said bottom panel and adapted to inhibit the movement of said front and rear walls in an outward direction;

a plurality of straps joining opposing side walls and retaining said container in a box-like configuration; and a cover panel removably joined to said side, front, and rear walls defining a closed container of predetermined volume;

whereby, when said side walls are in a collapsed condition, said front and rear walls are shaped and dimensioned to be horizontally positioned, one above the other, thereupon, and said cover panel is similarly shaped and dimensioned to be fitted atop said front and rear walls.

* * * * *